US005721203A

United States Patent [19]

Zuberi et al.

[11] Patent Number: 5,721,203

[45] Date of Patent: Feb. 24, 1998

[54] TRIPHASE DRAIN CLEANER AND METHOD

[76] Inventors: Manzar Zuberi; Jack Smothers; M. S. Shakil, all of 5901 W. Lincoln Ave., Morton Grove, Ill. 60053

[21] Appl. No.: 772,262

[22] Filed: Dec. 23, 1996

[51] Int. Cl.[6] ..... C11D 7/08; C11D 7/24; C11D 7/20; B08B 3/08

[52] U.S. Cl. ..... 510/195; 510/196; 510/417; 510/466; 134/40; 134/42; 134/22.16; 134/22.19

[58] Field of Search ..... 510/195, 196, 510/417, 466; 134/40, 42, 22.14, 22.19

[56] References Cited

U.S. PATENT DOCUMENTS

| | | | |
|---|---|---|---|
| 3,538,008 | 11/1970 | Ancel et al. | 252/146 |
| 3,553,146 | 1/1971 | Butke et al. | 252/170 |
| 3,947,567 | 3/1976 | Berg, Jr. et al. | 424/45 |
| 4,096,871 | 6/1978 | Vlahakis | 134/40 |
| 4,453,983 | 6/1984 | Berkeley | 134/22.14 |
| 4,498,933 | 2/1985 | Berkeley | 134/22.14 |
| 4,673,552 | 6/1987 | Young | 252/87 |
| 4,877,654 | 10/1989 | Wilson | 427/387 |
| 4,900,467 | 2/1990 | Smith | 252/95 |
| 4,990,377 | 2/1991 | Wilson | 427/387 |
| 5,106,524 | 4/1992 | Haskell, III | 252/142 |
| 5,429,764 | 7/1995 | Van Vlahakis et al. | 252/146 |
| 5,443,747 | 8/1995 | Inada et al. | 252/94 |
| 5,454,979 | 10/1995 | Kobayashi et al. | 252/358 |
| 5,635,469 | 6/1997 | Fowler et al. | 510/406 |

*Primary Examiner*—Douglas J. McGinty

[57] ABSTRACT

A triphase drain cleaner with hydrocarbon solvent and antifoam drain pipe coating. The triphase drain cleaner consists of a lower sulfuric acid base, an intermediate base consisting of a hydrocarbon solvent, and a top layer consisting of an antifoam slip/release agent. The lower base consists of at least 20 per cent sulfuric acid solution, with the middle base consisting of a hydrocarbon solvent capable of cleaning side walls of the drain pipe, while the upper section consists of an antifoam slip/release agent. The cleaning composition attacks drain blockage consisting of organic and inorganic matter and the foam typically associated with the composition's attack on the blockage. With the elimination of the unwanted foam by the antifoam, slip/release agent, it will also coat the drain side walls to reduce future deposits of matter that leads to drain blockage.

12 Claims, No Drawings

TRIPHASE DRAIN CLEANER AND METHOD

GENERAL DISCLOSURE

Sulfuric acid has been used to clean drains of many organic materials, including fats, hair, paper, cotton, tea and coffee grounds as well as some inorganic material such as hard water salts, lime scale and iron salts. The properties of sulfuric acid which makes it efficient for drain cleaning includes its high heat of dilution when brought into contact with residue water in the drain which melts many fats, greases and low melting compounds. It also reacts with a wide range of functional groups such as hydroxyl, carbonyl, esters, unsaturated bonds and amino groups. All of these known cleaning solutions produce an extreme quantity of foam which can cause unanticipated damage to fixture above the level of the drain. However none of the prior drain cleaners include a composite to provide a drain pipe side wall coating to reduce future deposits on the side walls of the drain pipe.

OBJECT OF THE INVENTION

It is an object of the present invention to provide a three layer composition for improved cleaning of a drain.

It is another object of this invention to provide a method of cleaning a drain using a triphase composition of sulfuric acid, a hydrocarbon solvent and an antifoam, slip/release agent.

DESCRIPTION OF THE INVENTION

The triphase drain cleaner of this invention has a composition of three liquid levels. The lower most dense layer makes up 50 to 98% of the total composition weight, with the preferred percentage being 94.1%. The middle layer, of intermediate density makes up 1 to 49.9999% of the total composition weight, with 5.894% being preferred. The upper, least dense layer make up from 0.001% to 1.00% of the total composition weight, with 0.006% being preferred.

The lower layer consists of at least 20% sulfuric acid solution.

The middle layer consists of a hydrocarbon solution capable of cleaning the side walls of the drain pipe.

The upper layer consists of an antifoam, slip/release agent.

The total composition attacks drain blockage consisting of organic and inorganic matter and the foam typically associated with its attack on the blockage, which foam is eliminated by the antifoam, slip/release agent which also coats the drain pipe side walls to reduce future deposit of matters that lead to drain blockage.

It has been determine that certain silicone fluids will not be affected by or have an affect on sulfuric acid solutions. These silicone fluids form an upper layer when incorporated into a composition consisting of sulfuric acid solution and certain hydrocarbon solutions and solution blends.

In the triphase or three layer composition the uppermost layer formed by the silicone fluids function to eliminate foam produced by sulfuric acid solution attack on organic and inorganic material. Also, as it passes over the drain pipe side walls during the cleaning process it leaves a coating on such walls, reducing future depositing of materials that lead to drain pipe blockages.

Drains are cleaned by the triphase composition in a unique manner. The denser sulfuric acid layer comes in contact with the water blocked in the drain. It melts and dissolves fats, hair, paper, cotton, tea, coffee grounds and tobacco, chalk, hard water salts, lime scale, and other organic and inorganic substances which can cause drain blockage.

Although the density of the lower sulfuric acid solution will vary with its strength, it will be denser than the hydrocarbon solution and will consequently be the lower layer in the composition. This guarantees complete contact sulfuric acid with the drain blockage.

While we have illustrated and described the preferred form of construction for carrying our invention into effect, this is capable of variation and modification without departing from the spirit of the invention. We therefore, do not wish to be limited to the precise details of construction as set forth, but desire to avail ourselves of such variations and modifications as come within the scope of the appended claims.

Having thus described our invention what we claim as new and novel and desire to protect by Letters Patent is:

1. A stable liquid triphase drain cleaning composition consisting essentially of, by weight, about 49.9997% to about 98% of a more dense layer of at least 20% sulfuric acid aqueous solution, about 1% to about 49.9999% of a less dense layer of at least one hydrocarbon solvent, and about 0.001% to about 1.00% of a lesser dense layer of a fluorosilicone fluid.

2. The composition of claim 1 wherein the amount of the more dense layer is about 94.1%.

3. The composition of claim 1 wherein the amount of the less dense layer is about 5%.

4. The composition of claim 1 wherein the amount of the less dense layer is about 5.894%.

5. The composition of claim 1 wherein the amount of the lesser dense layer is 0.006%.

6. The composition of claim 1 wherein the amount of the lesser dense layer is about 0.06%.

7. A drain cleaning process comprising contacting a drain with the composition of claim 1.

8. The process of claim 7 wherein the amount of the more dense layer is about 94.1%.

9. The process of claim 7 wherein the amount of the less dense layer is about 5%.

10. The process of claim 7 wherein the amount of the less dense layer is about 5.894%.

11. The process of claim 7 wherein the amount of the lesser dense layer is 0.006%.

12. The process of claim 7 wherein the amount of the lesser dense layer is about 0.06%.

* * * * *